United States Patent [19]

Atzet

[11] Patent Number: 4,513,706

[45] Date of Patent: Apr. 30, 1985

[54] ANTI-DIESELING DEVICE FOR DEMAND CARBURETORS

[76] Inventor: Jon E. Atzet, 1754 S. 10th East, Salt Lake City, Utah 84105

[21] Appl. No.: 634,425

[22] Filed: Jul. 26, 1984

[51] Int. Cl.[3] ..... F02M 7/12; F02B 77/08

[52] U.S. Cl. ..... 123/198 D; 123/DIG. 11; 123/327; 261/44 B; 261/44 C

[58] Field of Search ... 123/198 D, 198 DB, DIG. 11, 123/327; 261/44 C, 44 B

[56] References Cited

U.S. PATENT DOCUMENTS

| | | | |
|---|---|---|---|
| 3,792,696 | 2/1974 | Hollins | 123/DIG. 11 |
| 3,802,403 | 4/1974 | Dewick et al. | 123/DIG. 11 |
| 3,821,943 | 7/1974 | Toda et al. | 123/327 |
| 3,933,952 | 1/1976 | Elmore | 123/DIG. 11 |
| 4,111,176 | 9/1978 | Fenton et al. | 123/DIG. 11 |

FOREIGN PATENT DOCUMENTS

| | | | |
|---|---|---|---|
| 2412789 | 10/1974 | Fed. Rep. of Germany | 123/DIG. 11 |
| 59044 | 4/1982 | Japan | 123/DIG. 11 |
| 1365889 | 9/1974 | United Kingdom | 123/DIG. 11 |
| 1434002 | 4/1976 | United Kingdom | 123/DIG. 11 |

*Primary Examiner*—Ira S. Lazarus

*Attorney, Agent, or Firm*—M. Ralph Shaffer

[57] ABSTRACT

An anti-dieseling structure for demand carburetors wherein the air valve of a particular demand carburetor is provided with an exteriorly actuated lift lever, the same, when hand actuated, operates to lift the air valve. The tapered metering needle depending from the mechanically raised air valve is to make the fuel air mixture progressively more lean, with a carburetor operating at idle condition, to thereby starve the engine as to fuel intake and thus cause the engine to shut off in a positive manner and thus avoid dieseling. One or more carburetors may be accommodated by respective levers; where plural carburetors are employed, the levers are keyed to a common shaft that is rotated by control means leading to the dashboard at the driver's compartment. The engine, of course, will operate in the usual manner when the control cable coupled to the levers is not actuated, thereby leaving the air valves free to operate in the usual manner.

7 Claims, 8 Drawing Figures

ANTI-DIESELING DEVICE FOR DEMAND CARBURETORS

FIELD OF INVENTION

The present invention relates to anti-dieseling devices and, more particularly, to a new and improved anti-dieseling structure associated with one or more demand-type carburetors, wherein such structure includes levers that can be manually actuated, by virtue of the inclusion of a control cable leading to the vehicle dashboard, whereby the air valve can be lifted under carburetor conditions that make the fuel air mixture lean and hence starve the engine relative to fuel intake. In this way dieseling is prevented.

DESCRIPTION OF PRIOR ART

"Dieseling" refers to a common problem of an internal combustion engine continuing to run even though the ignition has been turned off. The problem arises in the case of availability only of fuels having insufficient octane rating for small, high compression engines, or where either internal carbon deposits, occasioned by use of low octane fuels, or the presence of a shaved head, for example, reduces the space between the head and the piston at top dead center position, such a condition increasing the compression at piston top dead center position. When such occurs and when a high vapor pressure fuel is not employed, dieseling is apt to occur. It is this that the present invention tends to avoid, namely, by providing "anti-dieseling" structure.

The present invention is related in general to demand-type carburetors, and particularly to demand-type carburetors of the side-draft or side-opening type. Certain prior United States Patents are known which bear upon anti-dieseling devices in general, but not for demand-type carburetors, and which are related somewhat, not here, to carburetors equipped with throttle pumps: U.S. Pat. Nos. 3,577,966, 3,841,282 3,635,203, 3,792,696 3,795,237.

U.S. Pat. No. 3,577,966 relates to an anti-dieseling system and, similar to the present invention, simply reduces the supply of idling fuel to the engine. However, in this patent an air storage container and also an electrical solenoid valve must necessarily be employed; this patent teaches totally dissimilar structure in the applicant's invention and is not related to sidedraft carburetors as described herein.

U.S. Pat. No. 3,795,237 has a relationship to the present invention in a modification of the carburetor fuel air mixture as flows to the engine. But here in this patent an air valve bleed system is used and has no independent operator control.

In U.S. Pat. No. 3,841,282, the structure shown relates somewhat to the present invention; however, in the patent reference the usable valve in the system comprises part of a multiple stage air-supply system which is not operator actuated but simply is responsive to the outlet pressure of such system.

In U.S. Pat. No. 3,792,696, there is in fact an operator control provided; however, the structure indicated as to how such might be employed in connection with the air valves of side drafttype-demand carburetors.

BRIEF DESCRIPTION OF THE PRESENT INVENTION

At the outset, a carburetor used in conjunction with the present invention has an air valve backed by a vacuum chamber or bowl which communicates by suitable port means to the intake manifold of the engine. Depending from the air valve is a tapered fuel metering valve which fits into a cylindrical orifice or jet that leads to the fuel reservoir. The throttle control, of course, is coupled to the butterfly which is disposed between the venturi, formed by the air valve and the "bridge" of the carburetor, and the flange connecting to the intake manifold. In the usual operation of the engine, the butterfly valve is "cracked" to idle position, the venturi is markedly restricted, owing to the small space between the air valve and the bridge, thus leaving a small annular fuel opening sufficient to supply fuel proximate the bridge for transport by inlet air past the cracked butterfly valve into the intake manifold of the engine. A greater throttle setting increases air flow through the venturi, thereby increasing negative pressure in the mixing chamber, which in turn lifts the air valve in direct proportion to throttle setting. A subsequent throttling of the engine by returning the butterfly valve toward its idle position, of course reduces the negative pressure of the manifold so as to allow the air valve to drop. What the present invention provides with this standard, demand-type carburetor is lever means which mechanically impinges upon and thus, upon actuation, raises the air valve so as to increase the cross-sectional open area of the fuel jet and simultaneously decrease the effectiveness of the venturi at the bridge by virtue of the expanded opening between the bridge and the air valve. Accordingly, and when the foot pedal is uppermost so that the engine would otherwise be in idling position, the butterfly valve being closed or nearly closed, then there is a reduced air flow through the carburetor toward the intake manifold and, since the venturi throat is substantially widened, there is insufficient negative pressure to draw the fuel upwardly into the bridge area. This is especially true since the position of the needle, being raised, is such that a larger cross-section is provided at the fuel jet which now would demand a substantial negative pressure condition to exist in order to draw the fuel upwardly. Accordingly, and even though the air volume is reduced by virtue of the closure of the butterfly, the absence of sufficient venturi negative pressure at the fuel jet precludes the substantial drawing in of fuel so that the fuel air mixture becomes starved as to the fuel section, so that virtually no fuel is carried into the intake manifold. This starves the engine and the engine will cease to function. Accordingly, the glow plug effect at the engine due to carbonization of the spark plugs or the walls becomes ineffective to continue the running of the engine since no fuel is present to perpetuate such.

The lever used to raise manually the air valve of the carburetor is controlled by a control cable provided with a hand actuator at the dash of the vehicle. For more than one carburetor, a series of levers can be used that are ganged to a suitable control. In a preferred form of the invention, a rotatable shaft is provided which mounts all of the levers, a suitable control and link arm being employed to rotationally displace the lever shaft in accordance with the push-pull operation of the control cable.

OBJECTS

Accordingly, a principal object of the present invention is to provide an anti-dieseling and hot-start device for vehicle engines.

A further object is to provide anti-dieseling structure in association with a demand-type carburetor.

Another object of the invention is to provide anti-dieseling structure which is manually actuatable, and which relies upon reducing the venturi effect proximate the fuel jet at times when the throttle control is in an idle condition.

A further object is to provide an anti-dieseling system for a demand-type carburetor wherein normal operation of the customary air valve at throttle condition is overcome by lifting the air valve, by manual means, so as to increase the venturi throat and hence reduce venturi negative pressure proximate the fuel jet so that, with the butterfly throttle control at proximate idle condition, there is insufficient negative venturi pressure available to lift fuel into the carburetor for transport into the intake manifold of the engine, thereby precluding dieseling of the engine once the engine is turned off.

BRIEF DESCRIPTION OF THE DRAWINGS

The features of the present invention, taken in conjunction with the appended claims, may best be understood by reference to the following detailed description, taken in connection with the accompanying drawings, in which:

DETAILED DESCRIPTION OF PREFERRED EMBODIMENTS

Figure 1:
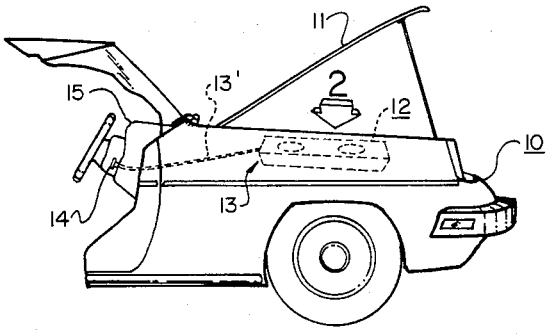
FIG. 1 is a fragmentary side elevation of an automobile incorporating the anti-dieseling device of the present invention.
Figure 4:
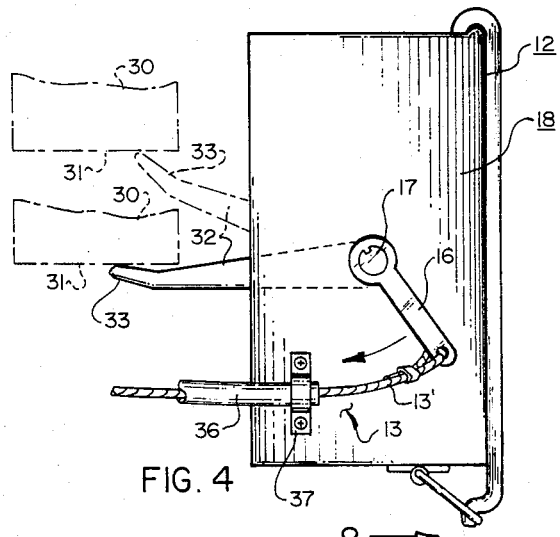
FIG. 4 is a side view taken along the line 4—4 in FIG. 2 and is enlarged as to scale, indicating various positions of the lever structure that cooperates with the undersurface of a representative carburetor's air valve.
Figure 5:
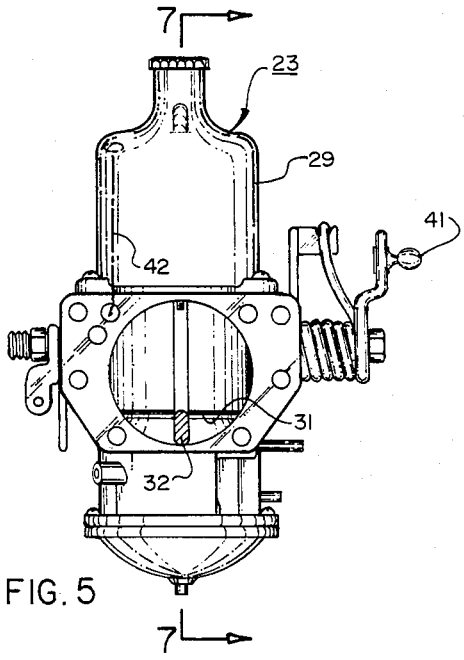
FIG. 5 is a front elevation of the carburetor of FIG. 3, but with the filter unit detached, showing however an engagement of the leve employed with the undersurface of the air valve of the carburetor.
Figure 6:
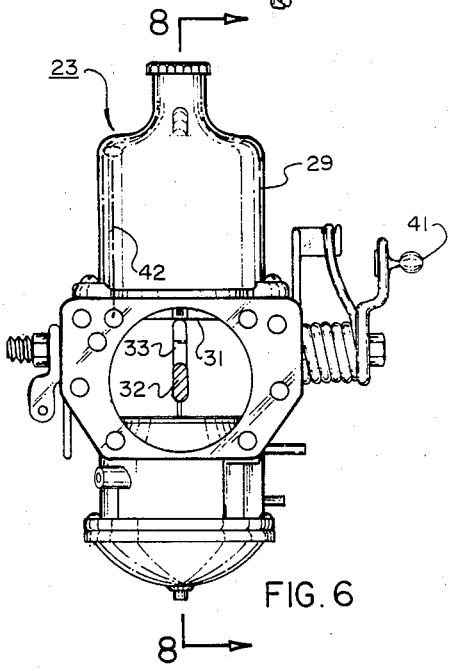
FIG. 6 is similar to FIG. 5 but illustrates the air valve as having been elevated by the lever structure of the anti-dieseling device.
Figure 7:
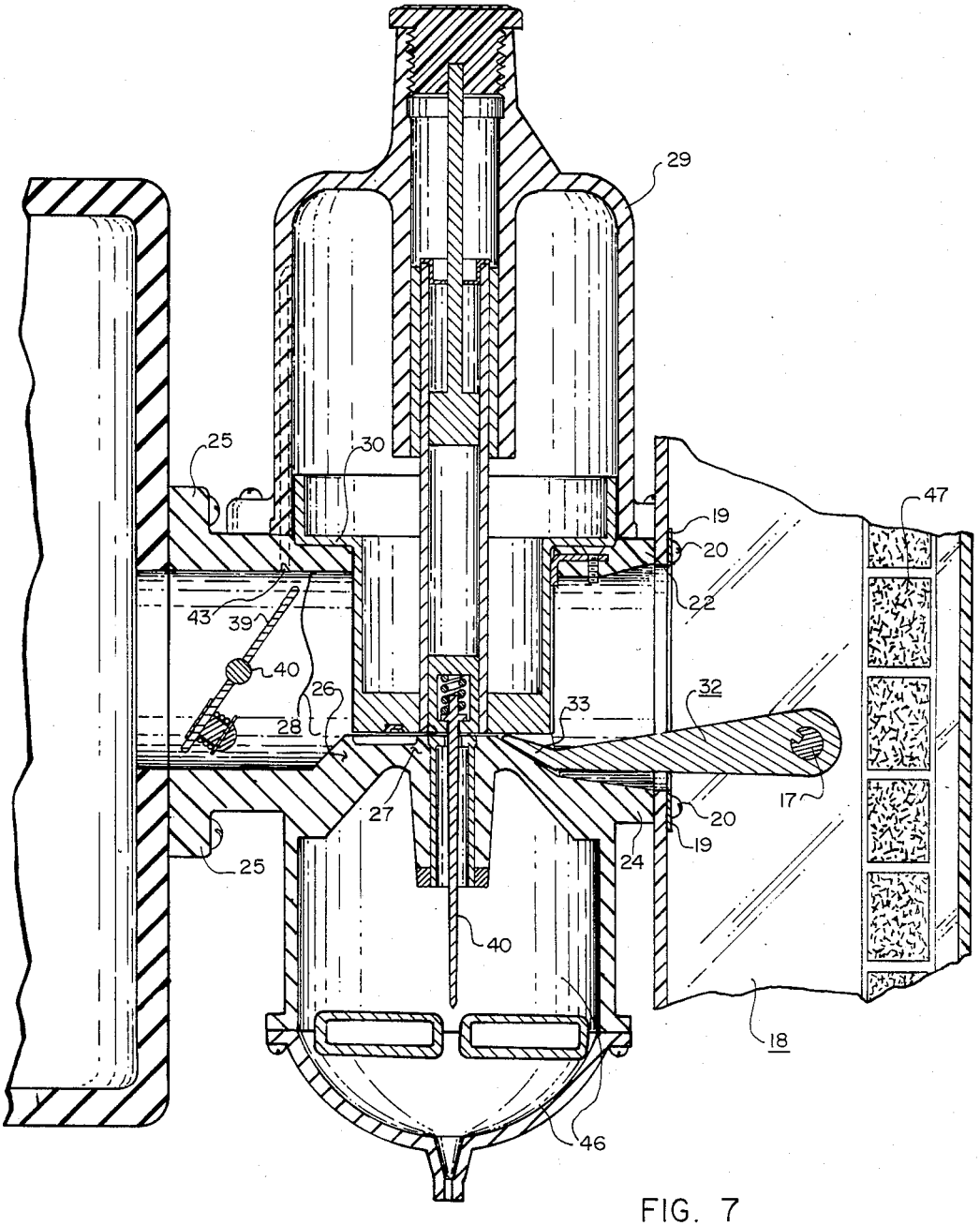
FIG. 7 is an enlarged section taken along the line 7—7 in FIG. 5.
Figure 8:
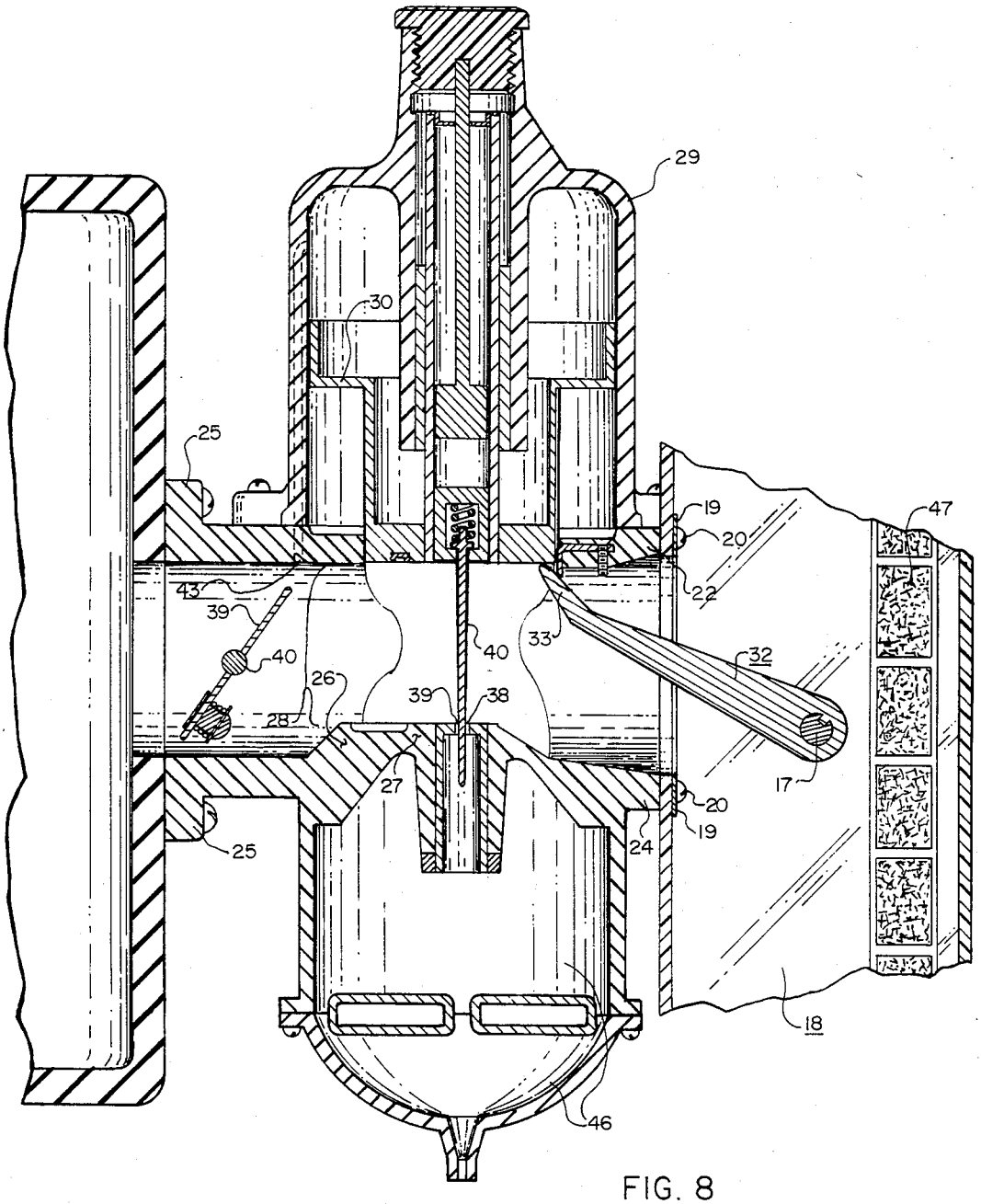
FIG. 8 is an enlarged vertical section taken along the line 8—8 in FIG. 6.

In FIG. 1 the vehicle 10 is shown to have its hood raised at 11. In dotted line is seen an air filter unit which forms part of anti-dieseling device 13 in FIG. 2. A control cable, otherwise termed a second means in the description herein, is seen at 13' and connects to a manual control 14 that is mounted to the dash 15 of the vehicle. Manual control 14 is of the push-pull, in-and-out actuated type and, referring to FIG. 4, serves to rotationally displace an actuator arm 16 that is fixed to shaft 17 journalled to case 18. Case 18 forms a part of a filter unit 12 seen in FIGS. 1 and 2. The case 18 has a pair of air intake apertures A and is supplied with respective metal plates 19 that are secured by screws 20, through the base 21 of case 18 to the air intake flange 22 of carburetor 23.

Figure 2:
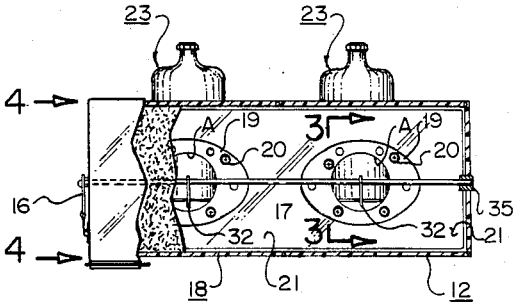
FIG. 2 is a view taken along the Arrow 2 in FIG. 1 and represents essentially a plan view, cut away for purposes of clarity, of the filter unit and anti-dieseling lever and shaft structure of the present invention.
Figure 3:
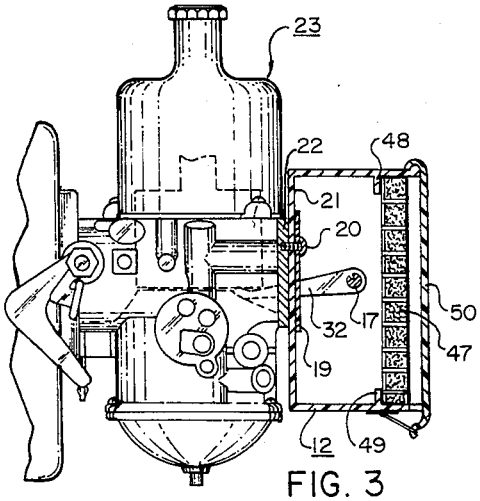
FIG. 3 is a side view of a side-draft demand-type carburetor incorporating the anti-dieseling structure of the invention within an attached air filter unit.

Carburetors 23, two being indicated in FIG. 2, are of the standard, side-draft demand-type, having a frontal air intake flange 22, an intake manifold flange 25, and interposed therebetween venturi structure 26 incorporating the standard bridge 27. Upstanding from the central section or throat 28 of the carburetor is a vacuum bowl 29, the structural details of which are well known to the art and which includes an air valve or piston 30. Air value 30 has an undersurface 31 which is engaged by lever 32. Where two carburetors are employed, as here, the undersurfaces 31 of the respective air valves 30 will be engaged by the upturned finger portion 33 of the lever. Levers 32, being mounted to shaft 17, are contructed for rotational displacement in accordance with the rotation of shaft 17. Shaft 17 is journalled by suitable bearings 35 in the case of 18. These bearings or journals will be disposed at opposite sides of the case. To actuator arm 16 will be tied the control cable 13, the latter including a standard flexible sheath 36 which is secured in place both at the dash by conventional means and also by bracket 37 to the case 18 proper.

Bridge 37 of the carburetor is supplied with a fuel jet 38 having an orifice 39 of circular cross-section. Fuel metering valve 40 is a tapered needle secured and spring-biased if desired, at 41 in the air valve 30.

The carburetor throat will be supplied with the usual butterfly throttle valve 39 that is journalled by conventional shaft 40, the latter having a throttle fitting 41 in the usual manner. Throttle fitting 41 is of course coupled by linkage to the accelerator in the vehicle. Communicating to a position in the vacuum bowl 29 above the air valve 30 is an atmospheric air bleed aperture 42 and also aperture 43 which communicates the negative pressure from the intake manifold to the upper side of the air valve 30 for providing a vacuum therefore.

As to the side-draft carburetor shown, the same is conventional in its construction, parts, and fuel metering valve at 40, the same ascending and descending in accordance with ascents and descents of the air valve 30. Since the needle is downwardly tapered, the greater the ascent of the air valve the greater will be the annular area of the orifice 39 at fuel jet 38, thereby requiring a greater vacuum to pull fuel upwardly from the fuel reservoir 46 into the venturi throat for fuel and air mixture flow to the intake manifold to the engine. Filter 47 rests upon flanges 48 and 49 and constitutes the usual air type filter. The case is provided with an air admittance cover 50, designed to snap over the top of case and yet being provided with accommodating apertures through the case and/or filter cover so that air might proceed to the filter area and from there by directed into the carburetor. The filter, of course, will be placed outside of the operational area of shaft 17 with its lever arm 32.

In operation, the side-draft demand-type carburetor functions as follows. As soon as the engine is cranked, one starts the process of producing a vacuum or negative pressure in the intake manifold of the engine. Thus, a negative head of pressure is here produced. As the engine is started by turning on the ignition and "cracking" the butterfly valve, a fuel air mixture passes through the carburetor into the intake manifold. This is by virtue of the venturi action at the bridge. Further, it is noted that the fuel introduced into the engine is exactly proportional to the throttle setting and hence the opening relative to the butterfly valve.

The vacuum port 43 is in communication with the intake manifold and hence, as the negative pressure will vary there, through the opening of the butterfly valve, the negative pressure above the air valve 30 will vary. This produces a greater or lesser extension of the air valve relative to the vacuum bowl pressures 29. The lower the bottom surface 31 of the air valve relative to the bowl, the greater the venturi constriction which is formed by the air valve and the bridge 37, and hence the lower the negative pressure at the venturi, because of throttle setting, and the flow of the outside air into the intake manifold. When fuel metering valve 40 is in a lower position, then the fuel orifice is constricted. Of course, when the engine is operating at low speed the negative pressure of the intake manifold is reduced; it follows that the negative pressure above the air valve 30 is reduced, as occasioned by the inclusion of vacuum port 43, so that the air valve will be in a downward orientation. At higher throttle settings, the greater negative pressure of the intake manifold of the engine, the more pronounced will be the rise of the air valve, thus opening the throat of the venturi and allowing for a greater onrush of air from the atmosphere through the air filter 47 provided.

If the throttle setting is reduced toward idle position, what happens is that the high pressure of the bridge is reduced and consequently air valve drops and metering needle falls more deeply into the metering jet. Consequently, lesser fuel is introduced into the engine and the engine runs, of course, more slowly. If the ignition is turned off, then combustion normally is not supported because the spark plugs no longer ignite. However, under carbon build-up conditions combustion chamber of the engine may act a glow plug and thereby support combustion as the carburetors continue to allow fuel through the demand system. What is accomplished in the present invention is the provision of an anti-dieseling device provided to mechanically lift the air valves so that at a given throttle setting, namely, at the idle throttle setting, one can artificially reduce the pressure magnitude of the bridge and the venturi, thereby reducing in suction power of the bridge and at the same time reduce the capability of pulling fuel from the reservoir into the venturi. Simultaneously, with the lifting of the air valve 30 there is automatically increased the annular orifice size between the metering jet and the metering needle, thereby making the suction requirement for siphoning fuel higher. Thus, more vacuum would be needed to lift the fuel into the venturi throat. However, since the butterfly is essentially closed at this point, that vacuum requirement is not supplied. Thus, fuel is not communicated into the engine and the engine will shut off. Plainly, it is the operation of the "first means" or lever 32 acting on the undersurface 31 of air control valve 30 so as to lift the same, which increases the venturi opening and therefore reduces the suction effect of the venturi relative to the fuel. Since the butterfly valve is nearly closed, there is an insufficient draft of air to draw fuel into the venturi area. Hence, the condition is that the engine is starved and the fuel air mixture becomes progressively more lean, and the engine shuts off.

It is noted that when the control 14 is pushed in completely, then the levers or first means, will be at their lowermost position, thereby rendering them essentially inoperative relative to the usual operation of the air valves under the influence of vacuum thereabove in vacuum bowl 29. It is only when the engine is idling and one seeks to pull the manual control at 14 that the levers are rotationally displaced in a clockwise direction, namely upwardly, so as to urge the undersurface 31 of the air valves upwardly, and hence the valves in the same direction, so as to open the throat even though the butterfly valve is closed. This drastically reduces the suction effect at the venturi and at the fuel jet so as to starve the mixture. The invention may be used for one, two or more carburetors. In connection with the two carburetors shown in FIG. 2, the levers 32 are simply ganged together on a common shaft 17. What is provided therefor, is an anti-dieseling system or device for demand type carburetors wherein the air valves thereof can be mechanically, "artificially" lifted at throttle idle condition so as to starve the fuel air mixture leading into the engine and thereby turn off the engine, eliminating anti-dieseling tendencies. The levers are inoperative during normal engine operations so as to allow the air valves to operate freely under the influence of vacuum conditions within their respective vacuum bowls 29.

In addition to the advantages above enumerated, it is to be noted that in starting a hot engine, one can actuate control 14 to lift the fuel needle valve and thus vent fuel reservoir pressures, to optimize starting conditions. Also, one might replace control 14 and cable 13' with solenoid operation of actuator arm 16 or its equivalent, if desired.

While particular embodiments of the present invention have been shown and described, it will be obvious to those skilled in the art that changes and mofidications may be made without departing from this invention in its broader aspects, and, therefore, the aim in the appended claims is to coval all such changes and modifications as fall within the true spirit and scope of this invention.

I claim:

1. In combination: a side-draft demand-type carburetor having a venturi throat in part defined by a raised bridge and movable air valve disposed thereover and having an undersurface, a vacuum bowl slideably receiving said air valve as a piston and constructed to reflect intake manifold pressure behind said air valve, said air valve having a downwardly tapered fuel metering valve depending therefrom proximate said venturi throat, said bridge area being provided with a fuel jet receiving said fuel metering valve, whereby the cross-sectional spacing between said fuel metering valve and said fuel jet increases progressively as said fuel metering valve is progressively raised, said carburetor having air-intake and intake-manifold flanges on opposite sides of said venturi throat, said carburetor including a throttle-butterfly valve disposed between said venturi throat and said intake-manifold flange; a manual control; first means for selectively lifting said air valve; and second means intercoupling said manual control with said first means for translating movements of said manual control to movement of said first means, whereby said first means selectively mechanically actuates said air valve independently of said vacuum bowl.

2. The structure of claim 1 wherein said carburetor is provided with an air intake filter unit having a case, filter means disposed in said case, and a shaft journalled in said case, said first means comprising a lever secured to said shaft and liftingly abutting said air valve for axial movement thereof, said shaft having an actuator arm, said second means comprising a control cable coupled to said actuator arm.

3. The structure of claim 2 wherein said lever has an upturned finger contracting said undersurface of said air valve to effectuate the selective lifting thereof.

4. An air filter unit for demand-type carburetors having a case, a filter included in said case, a shaft journalled in said case beneath said filter and carrying a carburetor air valve actuator lever, and means for manually rotationally displacing said shaft.

5. In combination, a pair of side-by-side disposed side-draft demand-type carburetors, each of said carburetors having a venturi throat in part defined by a movable air valve having an undersurface, a vacuum bowl slideably receiving said air valve as a piston constructed to reflect intake manifold pressure behind said air valve, said air valve having a downwardly tapered fuel metering valve depending therefrom proximate said venturi throat, said carburetor having a bridge area also defining said venturi throat and provided with a fuel jet receiving said fuel metering valve, whereby the cross-sectional spacing between said fuel metering valve and said fuel jet increases progressively as said fuel metering valve is progressively raised, said carburetors having air-intake and intake-manifold flanges on opposite sides of said venturi throat, said carburetors including a throttle-butterfly valve disposed between said venturi throat and said intake-manifold flange; a manual control; first means for simultaneously lifting said air valves; and second means intercoupling said manual control with said first means for translating movements of said manual control to movement of said first means, whereby said first means selectively actuates said air valves independently of said vacuum bowls.

6. The structure of claim 5 wherein said first means comprises an air filter unit coupled to said air-intake flanges and having a journalled shaft, levers as said first means secured to said shaft and engaging said air valves for axial movement thereof, said second means comprising a control cable terminating in a lever actuator radially secured to said shaft.

7. In combination: a side-draft demand-type carburetor having a venturi throat in part defined by a raised bridge and movable air valve disposed thereover and having an undersurface, a vacuum bowl slideably receiving said air valve as a piston and constructed to reflect intake manifold pressure behind said air valve, said air valve having a downwardly tapered fuel metering valve depending therefrom proximate said venturi throat, said bridge area being provided with a fuel jet receiving said fuel metering valve, whereby the cross-sectional spacing between said fuel metering valve and said fuel jet increases progressively as said fuel metering valve is progressively raised, said carburetor having air-intake and intake-manifold flanges on opposite sides of said venturi throat, said carburetor including a throttle-butterfly valve disposed between said venturi throat and said intake-manifold flange; a manual control; first means for selectively lifting said air valve; and second means for actuating said first means independently of the position of said butterfly valve.

* * * * *